US007153239B1

(12) United States Patent
Stearns et al.

(10) Patent No.: US 7,153,239 B1
(45) Date of Patent: Dec. 26, 2006

(54) EXERCISE METHODS AND APPARATUS

(76) Inventors: Kenneth W. Stearns, P.O. Box 55912, Houston, TX (US) 77255; Joseph D. Maresh, P.O. Box 645, West Linn, OR (US) 97068-0645

( * ) Notice: Subject to any disclaimer, the term of this patent is extended or adjusted under 35 U.S.C. 154(b) by 0 days.

(21) Appl. No.: 11/200,877

(22) Filed: Aug. 9, 2005

(51) Int. Cl.
*A63B 22/04* (2006.01)
*A63B 69/16* (2006.01)

(52) U.S. Cl. ..... 482/52; 482/51

(58) Field of Classification Search ..... 482/51–52, 482/57, 70, 79–80
See application file for complete search history.

(56) References Cited

U.S. PATENT DOCUMENTS 5,792,027 A * 8/1998 Gvoich ..... 482/51
5,876,307 A * 3/1999 Stearns et al. ..... 482/51
5,910,072 A * 6/1999 Rawls et al. ..... 482/51
6,248,044 B1 * 6/2001 Stearns et al. ..... 482/52
6,283,895 B1 * 9/2001 Stearns et al. ..... 482/52
6,436,007 B1 * 8/2002 Eschenbach ..... 482/52
6,761,665 B1 * 7/2004 Nguyen ..... 482/51
6,949,053 B1 * 9/2005 Stearns et al. ..... 482/52

* cited by examiner

*Primary Examiner*—Stephen R. Crow

(57) ABSTRACT

An exercise apparatus includes left and right foot links having first end portions rotatably connected to respective cranks, intermediate portions constrained to move in reciprocating fashion, and opposite, second end portions configured to support a person's feet. The resulting assembly links rotation of the cranks to movement of the foot supports through generally elliptical paths. Outboard handlebars are connected to the intermediate portions of the foot links to facilitate coordinate arm exercise without interfering with the leg exercise motion.

2 Claims, 8 Drawing Sheets

EXERCISE METHODS AND APPARATUS

FIELD OF THE INVENTION

The present invention relates to exercise methods and apparatus and more particularly, to exercise equipment that facilitates combined upper body and lower body exercise, including elliptical foot motion.

BACKGROUND OF THE INVENTION

Exercise equipment has been designed to facilitate a variety of exercise motions. For example, treadmills allow a person to walk or run in place; stepper machines allow a person to climb in place; bicycle machines allow a person to pedal in place; and other machines allow a person to skate and/or stride in place. Yet another type of exercise equipment has been designed to facilitate relatively more complicated exercise motions and/or to better simulate real life activity. Such equipment typically uses some sort of linkage assembly to convert a relatively simple motion, such as circular, into a relatively more complex motion, such as elliptical. Exercise equipment has also been designed to facilitate full body exercise. For example, reciprocating cables or pivoting arm poles have been used on many of the foregoing types of exercise equipment to facilitate contemporaneous upper body and lower body exercise. Despite many such advances in the art, room for improvement remains, particularly with regard to coordinated arm movement on elliptical striding machines.

SUMMARY OF THE INVENTION

The present invention may be seen to provide a novel linkage assembly and corresponding exercise apparatus suitable for linking circular motion to relatively more complex, generally elliptical leg motion and contemporaneous arm exercise motion. On a preferred embodiment, for example, left and right foot links have first end portions rotatably connected to respective cranks, intermediate portions constrained to move in reciprocating fashion, and opposite, second end portions configured to move a person's feet through generally elliptical paths. Outboard handlebars are connected to the intermediate portions of the foot links in a manner that facilitates coordinate arm exercise motion without interfering with the leg exercise motion. Additional features of the present invention may become more apparent from the more detailed description set forth below.

BRIEF DESCRIPTION OF THE DRAWING

With reference to the Figures of the Drawing, wherein like numerals represent like parts and assemblies throughout the several views.

DETAILED DESCRIPTION OF THE PREFERRED EMBODIMENT

An exercise apparatus constructed according to the principles of the present invention is designated as 100 in FIGS. 1–4. The apparatus 100 generally includes a frame 110 and a linkage assembly movably mounted on the frame 110. Generally speaking, the linkage assembly moves relative to the frame 110 in a manner that links rotation of right and left cranks 120 and 122 to generally elliptical motion of right and left foot links 130.

Figure 1:
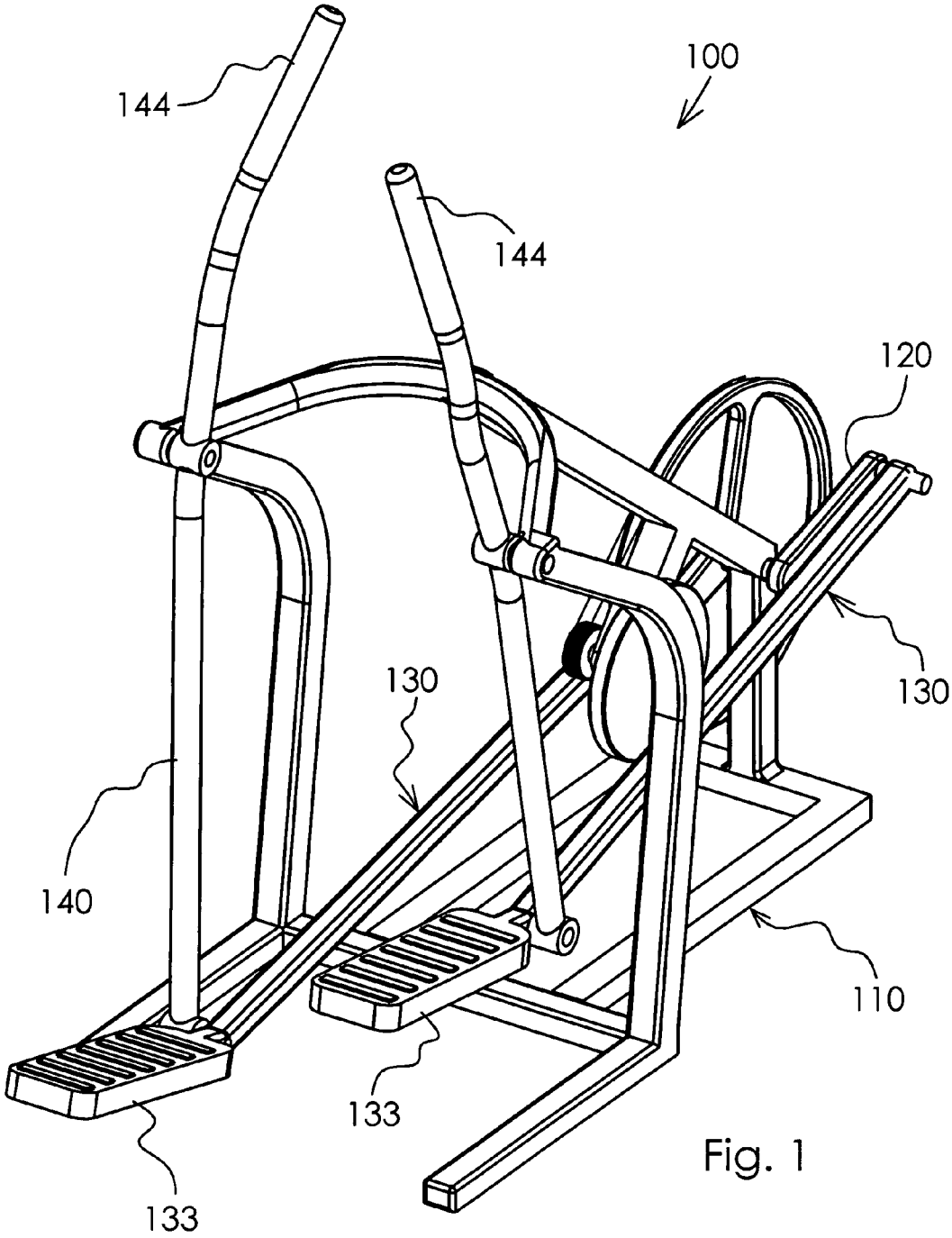
FIG. 1 is a perspective view of an exercise apparatus constructed according to the principles of the present invention.
Figure 2:
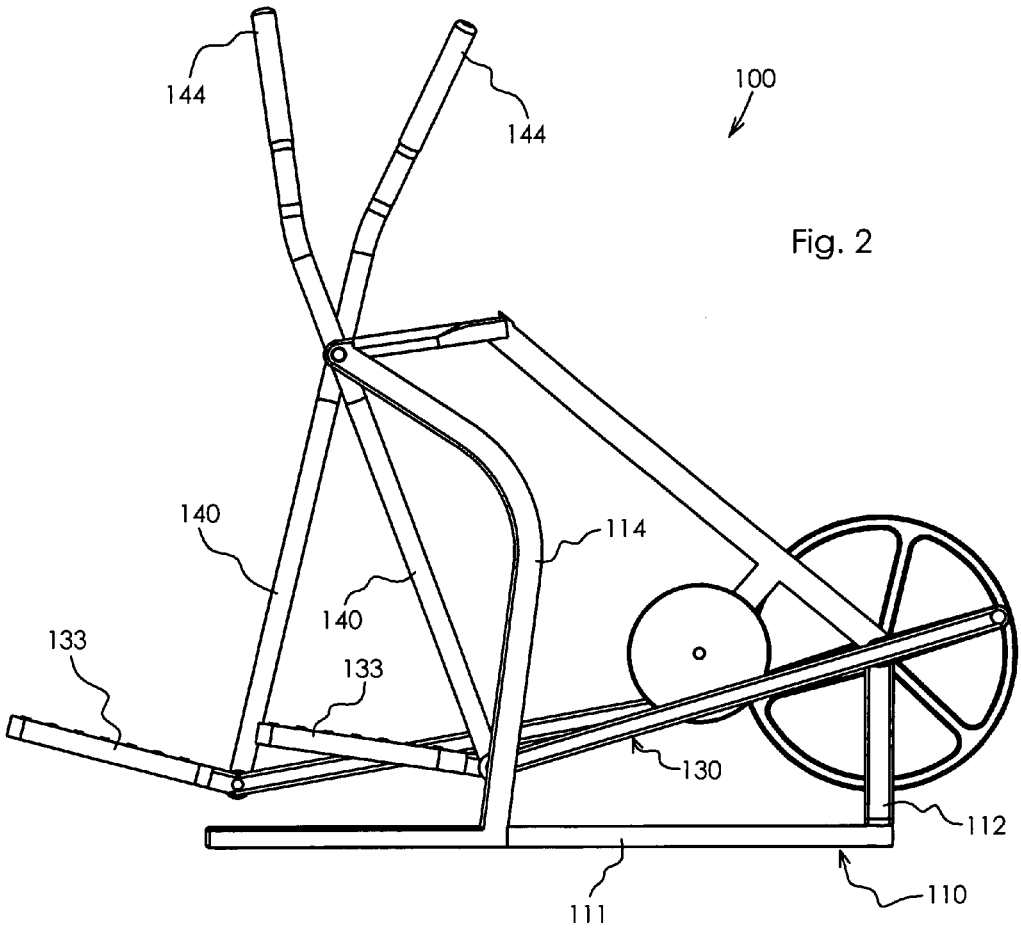
FIG. 2 is a side view of the exercise apparatus of FIG. 1.

As shown in FIG. 2, the frame 110 may be described in terms of a base 111, a forward stanchion 112, and an intermediate stanchion 114. The base 111 may be described as two generally U-shaped members rigidly interconnected in series, and designed to rest on a horizontal floor surface. The apparatus 100 is generally symmetrical about a vertical plane extending lengthwise through the base 111 (perpendicular to the middle portions of the U-shaped members), the only exceptions being components associated with an optional resistance assembly, and the relative orientation of certain parts of the linkage assembly on opposite sides of the plane of symmetry. On the embodiment 100, the "right-hand" components are one hundred and eighty degrees out of phase relative to the "left-hand" components. However, like reference numerals are used to designate common "right-hand" and "left-hand" parts on the apparatus 100, and when reference is made to one or more such parts on only one side of the apparatus, it is to be understood that corresponding part (s) are disposed on the opposite side of the apparatus 100.

Figure 4:
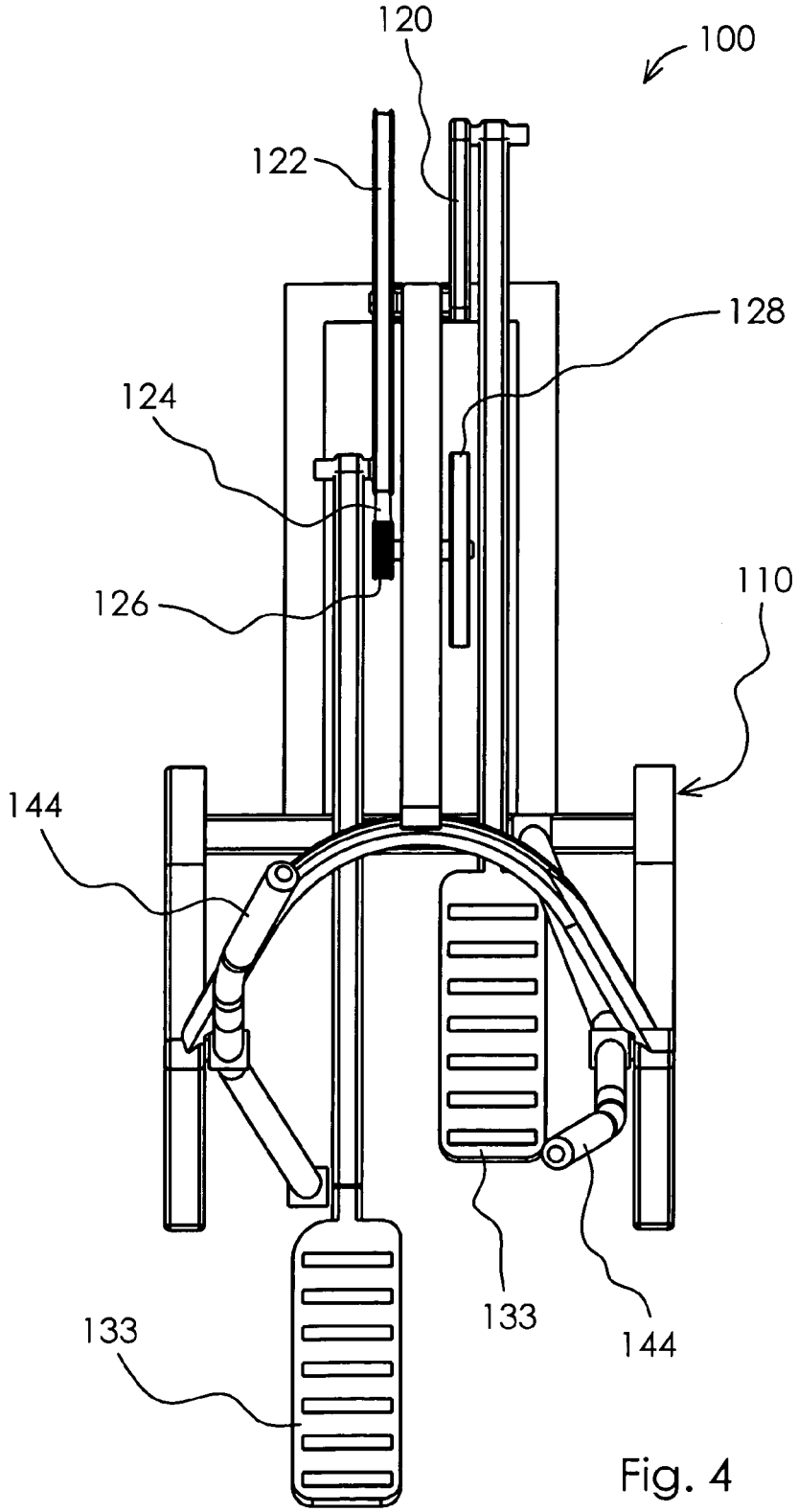
FIG. 4 is a top view of the exercise apparatus of FIG. 1.
Figure 5:
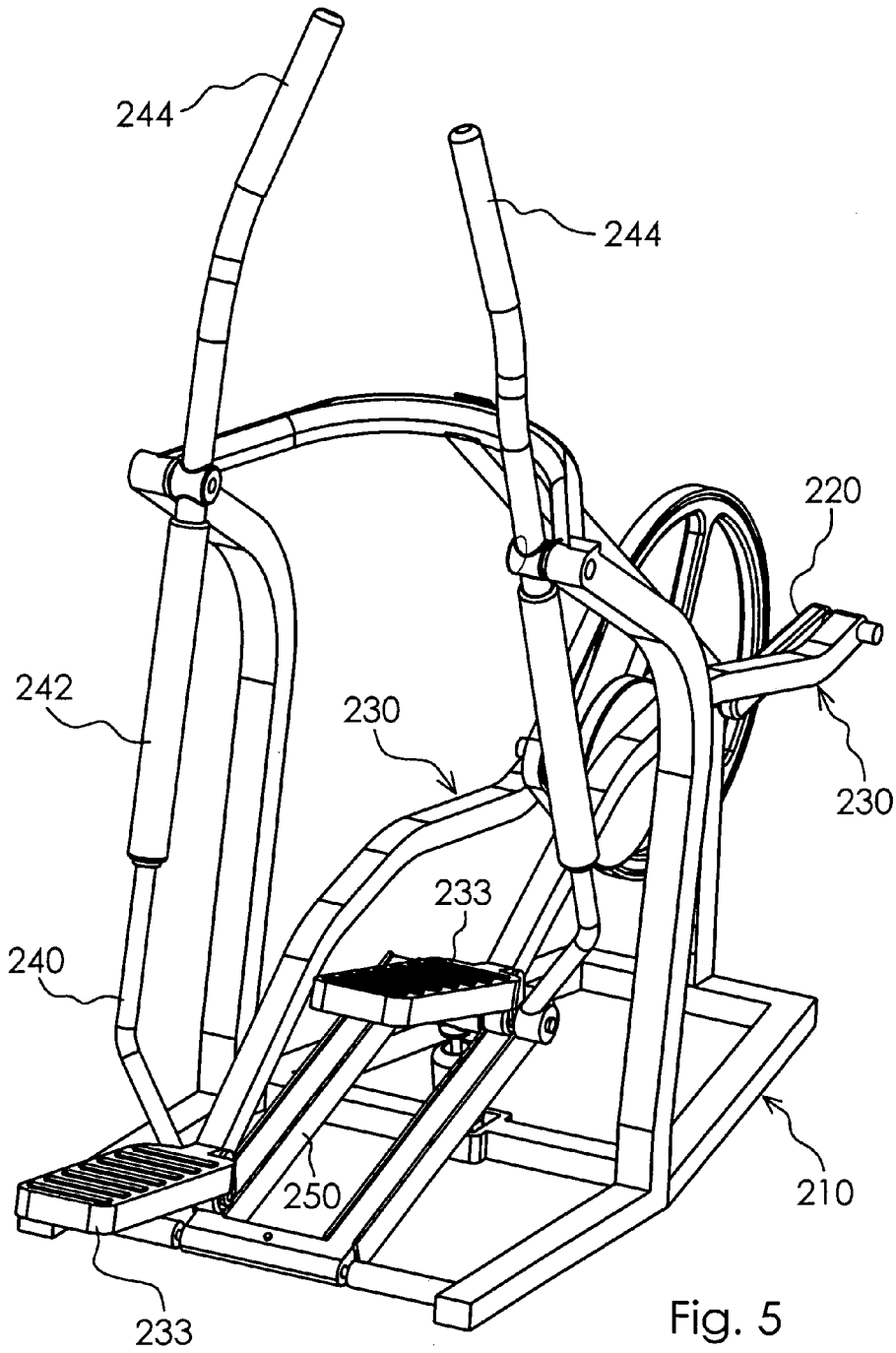
FIG. 5 is a perspective view of another exercise apparatus constructed according to the principles of the present invention.

The forward stanchion 112 extends upward from a forward end of the base 111. Right crank arm 120 and left crank wheel 122 are rigidly interconnected to one another, and rotatably mounted to the forward stanchion 112 by means known in the art, and thereby define a common crank axis. As shown in FIG. 4, a flywheel 128 is rotatably mounted on the frame 110 proximate the forward stanchion 112 for rotation about a discrete flywheel axis. The left crank wheel 122 is connected to the flywheel 128 by means known in the art to provide a "stepped up" flywheel arrangement. In particular, a belt 124 is formed into a closed loop about the left crank wheel 122 and a relative smaller diameter pulley 126 that is secured to the same shaft as the flywheel 128. As a result of this arrangement, the members 122 and 128 rotate together, but the latter rotates significantly faster than the former.

Those skilled in the art will recognize that other known types of inertia altering mechanisms may be added to or substituted for the stepped up flywheel arrangement. For example, a drag strap or eddy current brake assembly may be provided to selectively impede rotation of the flywheel 128. Moreover, the apparatus 100 could be built so that friction forces acting on the joints provide sufficient resistance to exercise movement. Those skilled in the art will also recognize that a housing or shroud may be disposed over the stepped-up crank and flywheel assembly.

Figure 3:
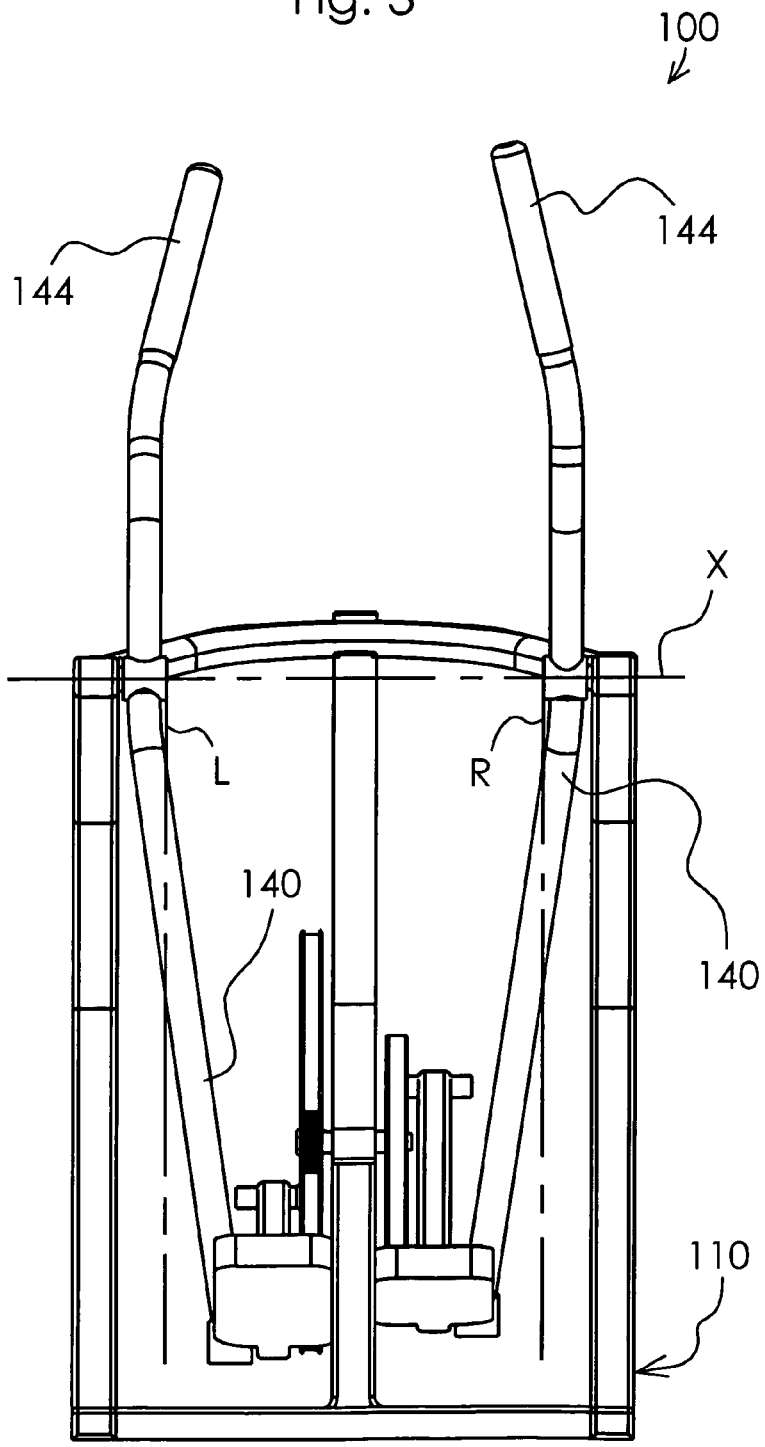
FIG. 3 is a rear end view of the exercise apparatus of FIG. 1.

Rigid right and left foot links 130 are movably interconnected between the frame 110 and respective cranks 120 and 122. In particular, a first end or distal portion of each foot link 130 is rotatably connected to a respective crank 120 or 122. Also, an intermediate portion of each foot link 130 is rotatably connected to a lower portion of a respective rocker link 140. An upper portion of each rocker link 140 is pivotally connected to a respective side of the intermediate stanchion 114, via a separate shaft but nonetheless defining a common pivot axis X (shown in FIG. 3). The rocker links 140 are mounted on respective sides of the frame 110 in a manner that defines a gap therebetween. The gap is bounded by planes L and R, which extend perpendicular to the axis X (and are also shown in FIG. 3).

A second end or distal portion of each foot link 130 may be described as a foot platform 133 that is sized and configured to support a person's foot. Each foot platform 133 is constrained (by the other links in the linkage assembly) to move through a respective elliptical path of motion. As shown in FIG. 3, the foot platforms 133 travel through paths disposed between the planes L and R, and the gap between the rocker links 140 accommodates the knees of a person standing on the foot supports 133.

Right and left hand grips 144 are preferably mounted on respective, upper distal ends of the rocker links 140. The hand grips 144 are sized and configured for grasping by a person standing on the foot platforms 133, and they facilitate arcuate arm exercise motion that is linked to elliptical movement of the foot platforms 133. In other words, movement of the foot platforms 133 is linked to rotation of the crank members 120 and 122, and to reciprocal movement of the rocker links 140. Among other things, the links 130 and 140 may be described as linking means, movably interconnected between the frame 110 and the crank members 120 and 122, for linking rotation of the crank members 120 and 122 to elliptical movement of the foot supports 133, and/or for linking rotation of the crank members 120 and 122 to reciprocal movement of the hand grips 144.

Another exercise apparatus constructed according to the principles of the present invention is designated as 200 in FIGS. 5–8. The apparatus 200 generally includes a frame 210 and a linkage assembly movably mounted on the frame 210. Generally speaking, the linkage assembly moves relative to the frame 210 in a manner that links rotation of right and left cranks 220 and 222 to generally elliptical motion of right and left foot links 230.

Figure 6:
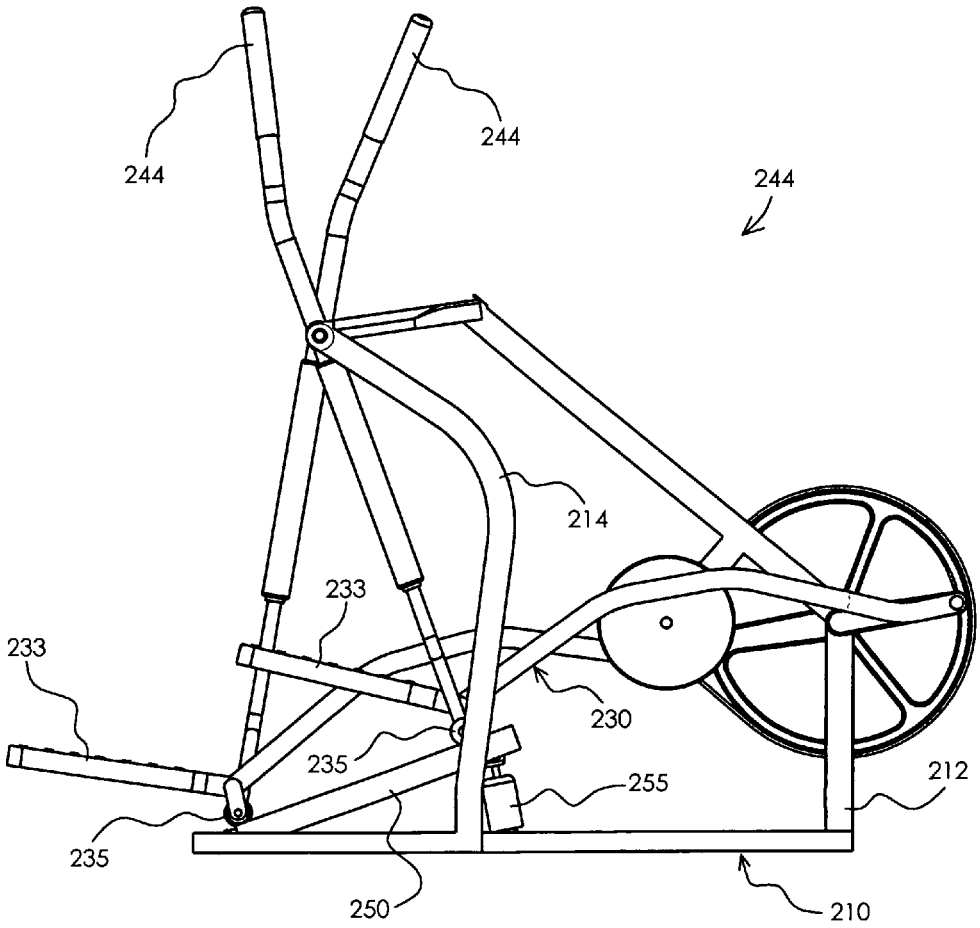
FIG. 6 is a side view of the exercise apparatus of FIG. 5.

As shown in FIG. 6, the frame 210 includes a base 211 configured to rest on a horizontal floor surface, a forward stanchion 212 that extends upward from a forward end of the base 211, and an intermediate stanchion 214 that extends upward from an intermediate portion of the base 211. The apparatus 200 is generally symmetrical about a vertical plane extending lengthwise through the base 211 (intersecting the forward stanchion 212), the only exceptions being components associated with an optional resistance assembly, and the relative orientation of certain parts of the linkage assembly on opposite sides of the plane of symmetry. On the embodiment 200, the "right-hand" components are one hundred and eighty degrees out of phase relative to the "left-hand" components. However, like reference numerals are used to designate common "right-hand" and "left-hand" parts on the apparatus 200, and when reference is made to one or more such parts on only one side of the apparatus, it is to be understood that corresponding part(s) are disposed on the opposite side of the apparatus 200.

Figure 8:
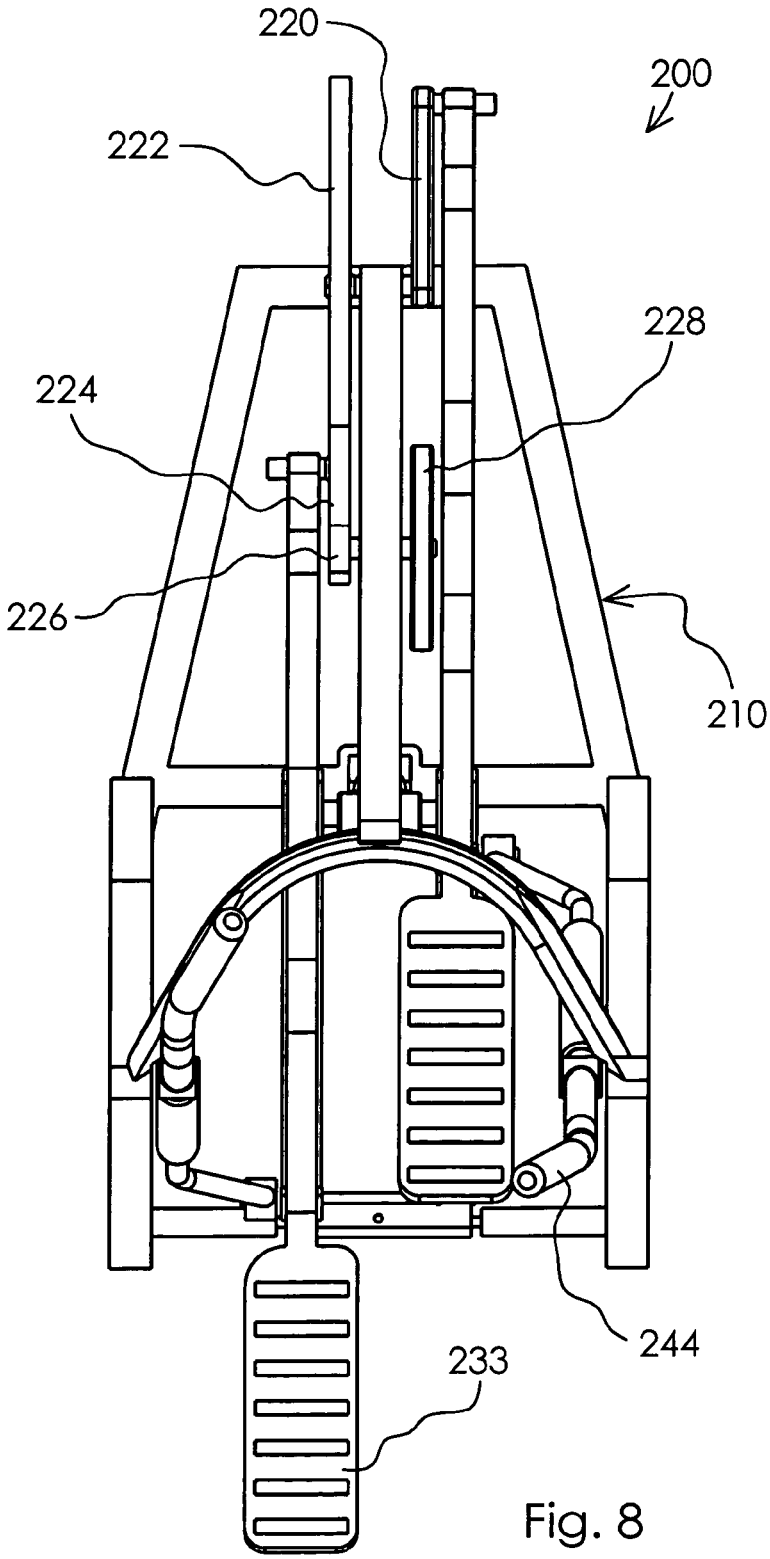
FIG. 8 is a top view of the exercise apparatus of FIG. 5.

Right crank arm 220 and left crank wheel 222 are rigidly interconnected to one another, and rotatably mounted to the forward stanchion 212 by means known in the art, and thereby define a common crank axis. As shown in FIG. 8, a flywheel 228 is rotatably mounted on the frame 210 proximate the forward stanchion 212 for rotation about a discrete flywheel axis. The left crank wheel 222 is connected to the flywheel 228 by means known in the art to provide a "stepped up" flywheel arrangement. In particular, a belt 224 is formed into a closed loop about the left crank wheel 222 and a relative smaller diameter pulley 226 that is secured to the same shaft as the flywheel 228. As a result of this arrangement, the members 222 and 228 rotate together, but the latter rotates significantly faster than the former.

Rigid right and left foot links 230 are movably interconnected between the frame 210 and respective cranks 220 and 222. In particular, a first end or distal portion of each foot link 230 is rotatably connected to a respective crank 220 or 222. Also, a respective roller 235 is rotatably mounted on an intermediate portion of each foot link 230, and supported from below by a guide or track 250 that is mounted on the frame 210. As shown in FIG. 6, an adjustable length member 255 is movably interconnected between the base 210 and the guide 250 to selectively adjust the orientation of the guide 250 relative to the base 210.

A second end or distal portion of each foot link 230 may be described as a foot platform 233 that is sized and configured to support a person's foot. Each foot platform 233 is constrained (by the other links in the linkage assembly) to move through a respective elliptical path of motion.

Figure 7:
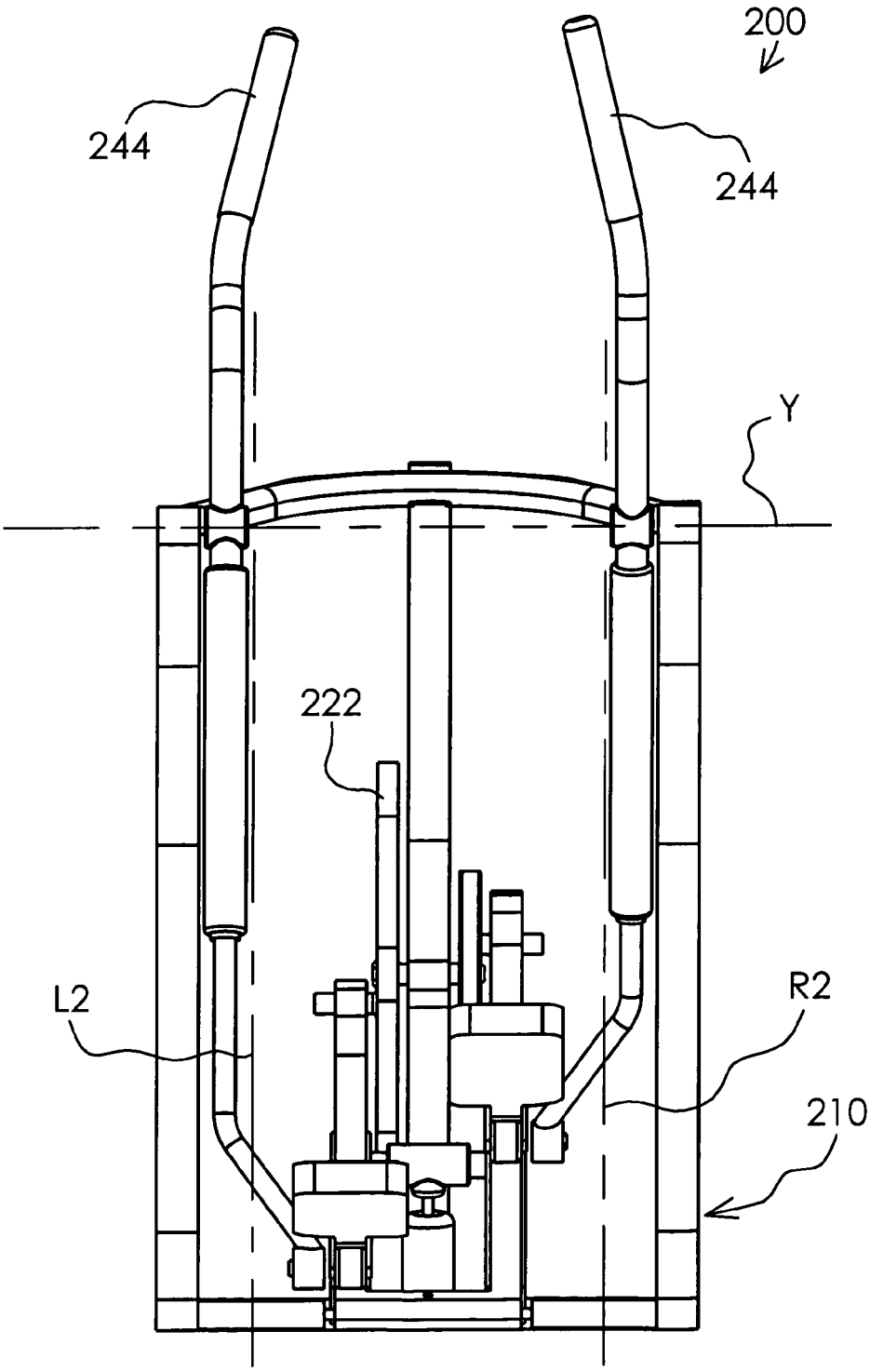
FIG. 7 is a rear end view of the exercise apparatus of FIG. 5.

Right and left links 240 are rotatably connected to respective foot links 230 in a manner that axial aligns with respective rollers 235. The links 240 are connected in telescoping fashion to respective lower portions of rocker links 242. An upper portion of each rocker link 240 is pivotally connected to a respective side of the intermediate stanchion 214, via a separate shaft but nonetheless defining a common pivot axis Y (shown in FIG. 7). The rocker links 242 are mounted on respective sides of the frame 210 in a manner that defines a gap therebetween. The gap is bounded by planes L2 and R2, which extend perpendicular to the axis Y (and are also shown in FIG. 7). The foot platforms 233 travel through paths disposed between the planes L2 and R2, and the gap between the rocker links 242 accommodates the knees of a person standing on the foot supports 233. An optional feature of the embodiment 200 is that the path traveled by the foot supporting members 233 may be adjusted by changing the length of the adjustable length member 255.

Right and left hand grips 244 are preferably mounted on respective, upper distal ends of the rocker links 242. The hand grips 244 are sized and configured for grasping by a person standing on the foot platforms 233, and they facilitate arcuate arm exercise motion that is linked to elliptical movement of the foot platforms 233. In other words, movement of the foot platforms 233 is linked to rotation of the crank members 220 and 222, and to reciprocal movement of the rocker links 240. Among other things, the links 230 and 250 may be described as linking means for linking rotation of the crank members 220 and 222 to elliptical movement of the foot supports 233, and/or together with the links 240 and 242 as linking means for linking rotation of the crank members 220 and 222 to reciprocal movement of the hand grips 244.

The foregoing disclosure and accompanying drawings are likely to enable persons skilled in the art to recognize additional embodiments, modifications, and/or features which nonetheless fall within the scope of the present invention. Recognizing that only some of the possible modifications and variations have been disclosed in detail, the scope of the present invention is to be limited only to the extent of the claims which follow.

What is claimed is:

1. An exercise apparatus, comprising:

a frame configured to rest on a floor surface;

right and left cranks rotatably mounted on said frame;

right and left rocker links pivotally mounted on respective sides of said frame, wherein a gap is defined between said sides; and right and left foot links having first ends movably connected to respective said cranks, intermediate portions movably connected to respective said rocker links, and opposite, second ends constrained to move through respective elliptical paths, wherein each of said second ends is configured to support a respective foot of a person within a vertical extension of said gap.

2. The exercise apparatus of claim 1, further comprising left and right hand grips mounted on respective upper distal ends of said rocker links.

* * * * *